US006578726B1

(12) United States Patent
Schaefer

(10) Patent No.: US 6,578,726 B1
(45) Date of Patent: Jun. 17, 2003

(54) CONTAINER LID WITH A PLURALITY OF AROMA VENT HOLES IN A CENTER PORTION OF A CONTAINER LID COVER

(76) Inventor: Debra L. Schaefer, 5447 S. Iola Way, Englewood, CO (US) 80111

( * ) Notice: Subject to any disclaimer, the term of this patent is extended or adjusted under 35 U.S.C. 154(b) by 0 days.

(21) Appl. No.: 09/394,108

(22) Filed: Sep. 10, 1999

Related U.S. Application Data

(63) Continuation of application No. 60/152,113, filed on Sep. 2, 1999.

(51) Int. Cl.[7] ..... B65D 51/18

(52) U.S. Cl. ..... 220/253; 215/387; 229/404; 220/713; 220/717; 220/367.1; 220/256.1

(58) Field of Search ..... D9/435, 447, 449, D9/450; D7/900; 229/404; 215/387; 220/367.1, 253, 373, 374, 368, 780, 711, 713, 716–719, 731, 371, 372, 703, 256, 287, 255; 222/548, 555, 484

(56) References Cited

U.S. PATENT DOCUMENTS 1,031,015 A * 4/1912 Lundgaard ..... 220/372 X
2,545,350 A * 3/1951 Fuld ..... 215/309
3,045,871 A * 7/1962 Hendrickson ..... 222/555 X
3,100,589 A * 8/1963 Love, Jr.
3,101,877 A * 8/1963 Driscoll
3,281,009 A * 10/1966 Collie et al.
3,805,991 A * 4/1974 Cheladze et al.
3,934,744 A * 1/1976 Curry
RE28,720 E * 2/1976 Sedlak
3,958,717 A * 5/1976 Ellis
4,074,827 A * 2/1978 Labe, III ..... 206/217
4,083,467 A * 4/1978 Mullins et al.
4,331,255 A * 5/1982 Fournier
4,487,114 A * 12/1984 Abdenour ..... 99/295
4,585,140 A * 4/1986 Lambert et al.
4,589,569 A * 5/1986 Clements
4,619,372 A * 10/1986 McFarland
4,705,188 A * 11/1987 Rahn ..... 220/366.1
4,723,391 A * 2/1988 Ashley et al.
4,723,684 A * 2/1988 Lambert et al.
4,762,246 A * 8/1988 Ashley et al.
4,869,389 A * 9/1989 Cerrone, Jr.

(List continued on next page.)

FOREIGN PATENT DOCUMENTS

DE 2318669 * 11/1974

OTHER PUBLICATIONS

US 6,003,721, 12/1999, Fleming (withdrawn)*

*Primary Examiner*—Robin Hylton
(74) *Attorney, Agent, or Firm*—Edwin H. Crabtree; Ramon L. Pizano; Donald W. Margolis

(57) ABSTRACT

A one piece and/or two piece container lid designed for allowing a beverage aroma to escape from a drink container for the enjoyment of the user of the container. The two piece container lid broadly comprises an upper lid cover and a lower lid cover. The upper lid cover includes an annular upper lid top portion with a downwardly extending skirt disposed around the outer circumference of the top portion. An upper lid drink opening is disposed on one side of the top portion. Next to the upper lid drink opening is an upper recess area formed in part of the top portion. The upper recess area includes a plurality of aroma vent holes therein. The lower lid cover includes an annular lower lid top portion with a raised rim therearound. The rim includes a lower lid drink opening in one side thereon. A downwardly extending exterior flange is disposed around the outer circumference of the rim. The flange includes first and second lip grooves for receiving different diameter containers. A lower recess area is formed in the lower lid top portion. The lower recess area also includes outwardly extending stops and a plurality of aroma vent holes therein. An inner circumference of the upper lid skirt is received around an upper portion of the flange of the lower lid cover in a snap/press fit.

14 Claims, 2 Drawing Sheets

U.S. PATENT DOCUMENTS 4,898,299 A * 2/1990 Herbst et al.
4,938,379 A * 7/1990 Kellner
4,953,743 A * 9/1990 Dart et al.
5,125,525 A * 6/1992 Tucker
5,168,140 A * 12/1992 Welker
5,253,781 A * 10/1993 Van Melle et al.
D354,682 S * 1/1995 van Spaandonk
5,395,006 A * 3/1995 Verma ..... 220/253 X
5,477,979 A * 12/1995 Goessling et al. ..... 220/713
5,531,347 A * 7/1996 Goulding
5,540,350 A * 7/1996 Lansky
5,624,053 A * 4/1997 Freek et al.
5,678,720 A * 10/1997 Van Melle
5,688,544 A * 11/1997 Bolton et al.
5,692,616 A * 12/1997 Baker
5,775,205 A * 7/1998 Melton
5,792,654 A * 8/1998 Bohannon et al. ..... 220/253 X
D400,397 S * 11/1998 Stepahn
5,941,404 A * 8/1999 Charrette
6,003,711 A * 12/1999 Bilewitz ..... 220/253
6,076,450 A * 6/2000 DiGiorgio, Jr.
6,095,033 A * 8/2000 Melton ..... 220/713 X
6,305,571 B1 * 10/2001 Chu ..... 215/387
6,311,863 B1 * 11/2001 Fleming ..... 220/713

* cited by examiner

CONTAINER LID WITH A PLURALITY OF AROMA VENT HOLES IN A CENTER PORTION OF A CONTAINER LID COVER

This patent application is a continuation-in-part application based on an earlier application titled "REMOVABLE POROUS CONTAINER LID AND LID WITH POROUS INSERT" filed by the subject inventor on Sep. 12, 1998 and having serial No. 60/152,113.

BACKGROUND OF THE INVENTION (a) Field of the Invention

This invention relates to a lid for a liquid container and more particularly, but not by way of limitation, to a one and/or a two piece container lid having a plurality of aroma vent holes therein to allow steam and aroma to escape from the container for adding drinking pleasure to the user of the container lid.

(b) Discussion of Prior Art

Heretofore, there have been a variety of different types and designs of removable plastic lids for liquid containers. The lids include drink openings, pressure relief openings and venting of gases from a heated liquid.

U.S. Pat. No. 4,619,372 to McFarland discloses a slit next to a drink opening in a single piece snap-on container lid. The slit is designed for allowing aroma to escape from a drinking container. The patent to McFarland provides no disclosure of a two piece container lid having a plurality of aroma vent holes disposed in an area where the nose of the user would be positioned when drinking from the containers upper and lower lid cover along with means for opening and closing the drink openings to prevent spillage.

U.S. Pat. No. 4,589,569 to Clements is an example of a typical plastic lid for a drinking cup is disclosed. The lid includes an annular mounting portion for releasably engaging a lip of a cup. The lid also includes a drink opening with a recess next to the drink opening. The recess accommodates an upper lip of a user of the drinking cup. U.S. Pat. No. 4,953,743 to Dart et al. desribes a splash proof lid for a drinking cup. The lid includes a raised circular vent with a vent opening. The raised vent with opening helps reduce spillage from the cup.

None of the above mentioned patents along with removable plastic container lid covers currently used in the marketplace provide the unique structure, objects and advantages of the subject one and two piece container lid as described herein.

SUMMARY OF THE INVENTION

In view of the foregoing, it is a primary object of the present invention to provide a one and/or two piece container lid which is designed to allow an aroma from a beverage to escape from a drink container for the enjoyment of the user of the container. Also, the container lid is designed to significantly reduce, if not eliminate, spillage of the beverage from the container when in use.

Another object of the unique container lid is to allow aroma to escape from the drink container through aroma vent holes. The aroma vent holes are positioned above a drink opening in the container lid in close proximity to the nose of the user of the container enabling the user to smell the aroma as it moves upwardly through the aroma vent holes.

Still another object of the invention is the container lid is designed to fit different sizes of containers used in holding coffee, tea and like beverages. The container lid can be used as a single lid cover or may include an upper lid cover received over the top of a lower lid cover in a press fit.

Yet another feature of the container lid is that the lid may be made up of a single container lid cover or a combination of an upper container lid cover attached to a lower container lid cover for covering the top of a drink container. The lid cover or lid covers are designed to insulate the liquid contents in the container so that the beverage stays hotter longer.

The two piece container lid is comprised broadly of an upper lid cover and a lower lid cover. The upper lid cover includes an annular upper lid top portion with a downwardly extending exterior upper lid skirt. The upper lid skirt is disposed around the outer circumference of the top portion. An upper lid drink opening is disposed on one side of the top portion. Next to the upper lid drink opening is an upper recess area with an upper recess wall disposed therearound. The upper recess area is generally triangular in shape and is formed in part of the top portion. A plurality of aroma vent holes are formed in the upper recess area. The upper recess area is designed to receive a portion of, a user's nose when drinking from a beverage drinking container.

The lower lid cover includes an annular lower lid top portion with a rim therearound. The rim includes a lower lid drink opening in one side thereon. A downwardly extending, exterior flange is disposed around the outer circumference of the rim. The flange includes first and second lip grooves for receiving lips of different diameter drink containers. A lower recess area with a lower recess wall disposed therearound is formed in the lower lid top portion. Also, a plurality of aroma vent holes are formed in the lower recess area.

An inner circumference of the upper lid skirt is received around an upper portion of the flange of the lower lid cover in a press fit. The upper recess area of the upper lid cover is received in the top of the lower recess area of the lower lid cover.

These and other objects of the present invention will become apparent to those familiar with removable plastic lids used with beverage containers when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DESCRIPTION OF THE PREFERRED EMBODIMENTS

Figure 1:
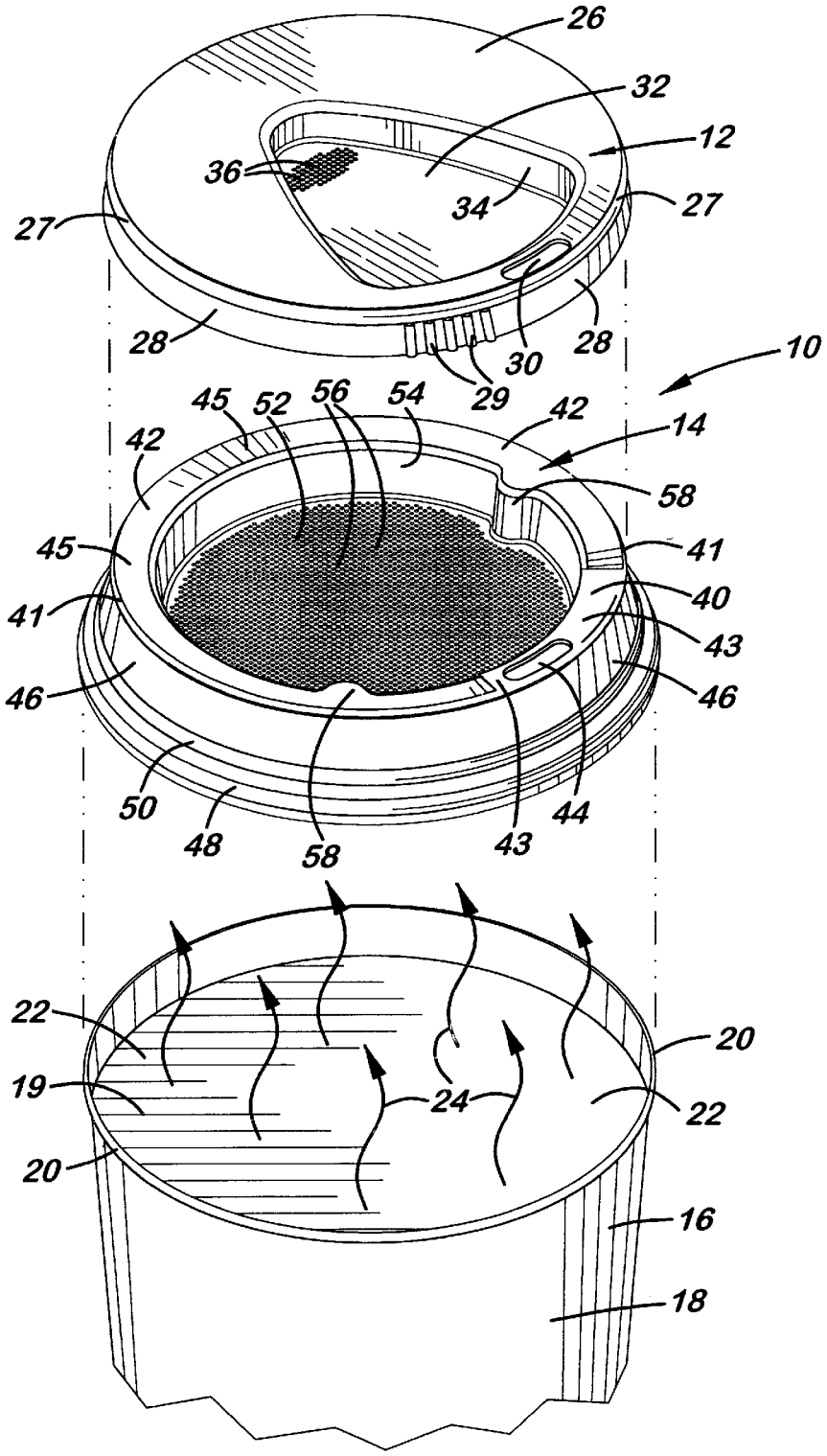
FIG. 1 illustrates an exploded perspective view of the two piece container lid. In this drawing, an upper lid cover is shown disposed above a lower lid cover. The lower lid cover is shown disposed above an upper portion of a drinking container. The drinking container is shown with a beverage and steam and aroma escaping upwardly therefrom.

In FIG. 1, an exploded perspective view of a two piece container lid is shown and having general reference numeral 10. The container lid 10 broadly includes an upper lid cover having a general reference numeral 12 and a lower lid cover having a general reference numeral 14. The lower lid cover 14 is shown disposed above an upper portion 16 of a drinking container 18 with an open top 19 and annular lip 20 therearound. The drinking container 18 is shown with a hot beverage 22 therein with steam and aroma, as indicated by arrows 24, escaping upwardly therefrom.

It should be mentioned that while the invention is described herein as a two piece container lid, it should be kept in mind that various embodiments of the upper lid cover 12 and the lower lid cover 14 can be used as a single cover for engaging the lip 20 of the drinking container 18 without departing from the spirit and scope of the invention.

Figure 2:
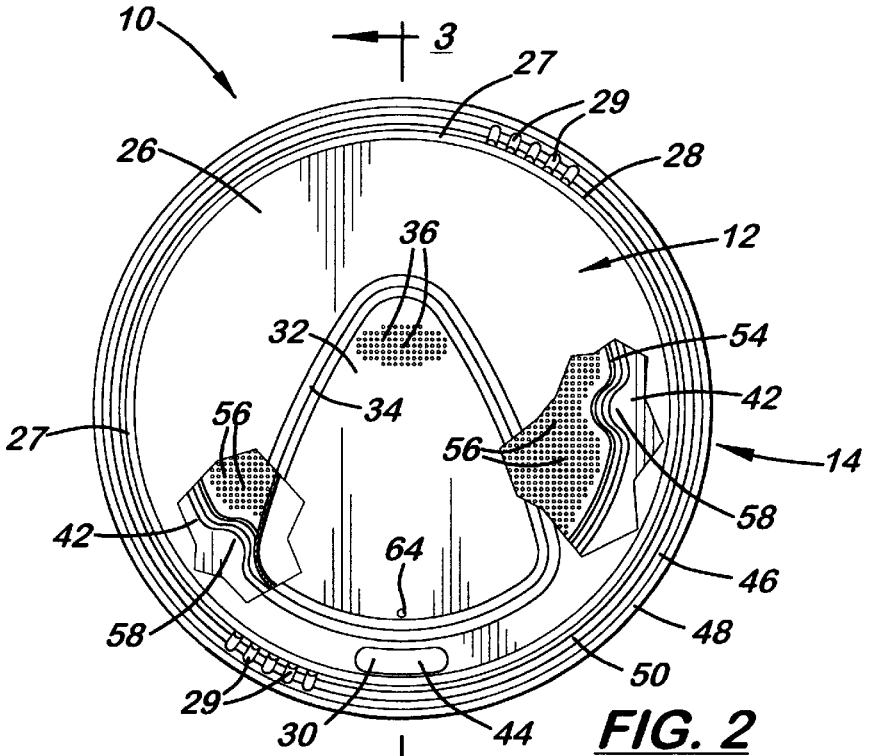
FIG. 2 is a top view of the two piece container lid with a portion of the top lid cover cut-away to expose the engaging of a stop in a lower recess wall with an upper recess wall.
Figure 3:
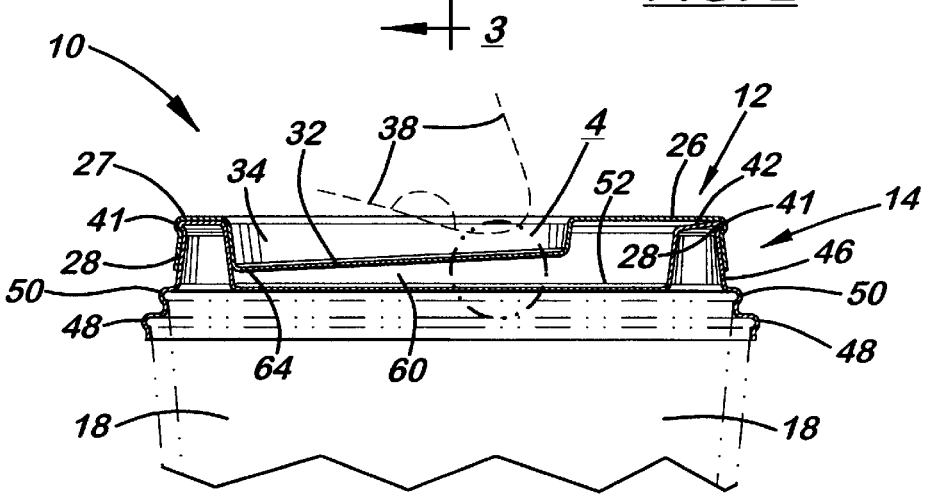
FIG. 3 is a side sectional view of the two piece container taken along lines 3—3 shown in FIG. 2.

The upper lid cover 12 includes an annular upper lid top portion 26 with a downwardly extending exterior upper lid skirt 28. The upper lid skirt 28 is disposed around the outer circumference of the top portion 26. The skirt 28 includes two sets of vertical ribs 29 on diagonally opposed sides of the skirt for helping rotate the upper lid cover 12 when it is engaged in a press fit on top of the lower lid cover 14 as shown in FIGS. 2 and 3. Both sets of vertical ribs 29 are shown in FIG. 2. An upper lid drink opening 30 is disposed on one side of the top portion 26. Next to the upper lid drink opening 30 is an upper recess area 32 with upper recess wall 34 disposed therearound. The upper recess area 32 is generally triangular in shape and is formed in part of the top portion 26. A plurality of aroma vent holes 36 are formed in the upper recess area 32. The upper recess area 32 is designed to receive a portion of a user's nose 38, shown in dashed lines in FIG. 3, when drinking from the beverage drinking container 18.

The lower lid cover 14 includes an annular lower lid top portion 40 with a raised rim 42 therearound. The rim 42 includes a lower lid drink opening 44 in one side thereon. In the rim 42 and on opposite sides of the drink opening 44 is a flat rim portion 43 which is used to engage the bottom of the upper lid top portion 26 next to the upper lid drink opening 30. The flat rim portion 43 provides for a complete contact of its surface area with the surface area in the bottom of the upper lid top portion 26 to help insure the complete opening and closing of the upper lid drink opening 30 with the lower lid drink opening 44 to minimize leakage of the beverage when using the container lid 10. Also, the rim 42 includes a downwardly angled rim portion 45 which is angled inwardly toward the center of the lower lid cover 14 to encourage any condensation or beverage spill to flow into the cup.

The lower lid cover 14 also includes a downwardly extending exterior flange 46 is disposed around the outer circumference of the rim 42. The flange 46 includes a first annular lip groove 48 and a second annular lip groove 50 for receiving lips of different diameter drink containers as shown in FIG. 3. A lower recess area 52 with lower recess wall 54 disposed therearound is formed in the lower lid top portion 40. Also, a plurality of aroma vent holes 56 are formed in the lower recess area 52. The lower recess wall 54 includes a pair of outwardly extending stops 58. The stops 58 are used to engage a portion of the upper recess wall 34 when the upper lid cover 12 is rotated on top of the lower lid cover 14.

In this drawing, an inner circumference of the upper lid skirt 28 is shown positioned for receipt around an upper portion of the flange 46 of the lower lid cover 14 in a press fit. The upper lid top portion 26 includes an upper lid groove 27 around its circumference. The upper lid groove 27 is received in a snap fit around an annular rim bead 41. The annular rim bead 41 is disposed around an outer circumference of the rim 42 of the cover lid cover 14. The snap fit of the upper lid groove 27 and the annular rim bead 41 can be seen in cross section in FIG. 3. Also, a portion of the upper recess area 32 of the upper lid cover 12 is received in the top of the lower recess area 52 of the lower lid cover 14 as shown in FIG. 3. Further, a lower portion of the flange 46 is shown positioned for receipt around the lip 20 of the upper portion 16 of the drinking container 18.

In FIG. 2, a top view of the two piece container lid 10 is shown with a portion of the upper lid cover 12 cut-away. In this view, a portion of the upper recess wall 34 is shown engaged against the side of one of the stops 58. When the upper lid cover 12 is rotated counterclockwise on top of the lower lid cover 14, the upper lid drink opening 30 is indexed with the lower lid drink opening 44 for drinking the beverage 22 from the drink container 18. When not thusly indexed, the effect is to "seal" the apparatus to significantly reduce, if not eliminate, spillage.

Also, shown in this drawing is a beverage drainage hole 64 in the bottom of the upper recess area 32 and next to upper lid drink opening 30. The bottom of the upper recess area 32 is angled slightly downwardly toward the drainage hole 64 so that any spillage of the beverage 22 from around the drink opening 30 or any spillage through the aroma vent holes 36 will drain back through the hole 64 and into the drinking container 18.

In FIG. 3, a side sectional view of the two piece container 10 is shown and taken along lines 3—3 shown in FIG. 2. In this view,the upper recess area 32 is shown nesting inside the lower recess area 52. Note that a space 60 is provide between the bottom of the upper recess area 32 and the top of the lower recess area 52. The space 60 provides for trapping any beverage 22 that might leak through the aroma vent holes 56 when the drink container 18 is tipped. This feature helps to reduce if not eliminate any spillage of the beverage when using the two piece container lid 10. When the drink container 18 is returned to an upright position, any trapped beverage 22 will drain back into the container.

Figure 4:
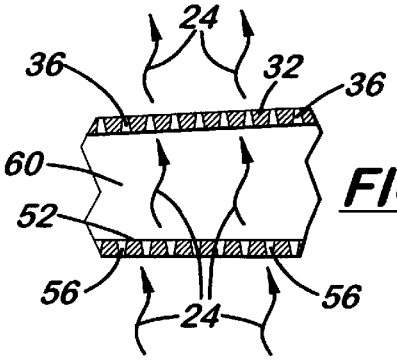
FIG. 4 is an enlarged view of a portion, as shown in FIG. 3, of the upper recess area and the lower recess area with aroma vent holes therein.

In FIG. 4, an enlarged view of a portion, as shown in FIG. 3, of the upper recess area 32 and the lower recess area 52 is shown with aroma vent holes 36 and 56 therein. In this drawing, it can be seen that the aroma vent holes 36 and 56 are funnel shaped. The aroma vent holes 36 are wider at the bottom of the upper recess area 32 to allow for increase aroma penetration as indicated by arrows 24. The aroma vent holes 56 are narrow at the bottom of the lower recess area 52 to reduce leakage of the beverage 22 into the space 60.

Figure 5:
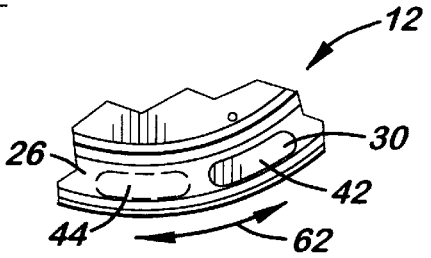
FIG. 5 is a top view of a portion of the upper lid cover with the upper lid drink opening shown in a closed position and with the lower lid drink opening shown in dashed lines.

In FIG. 5, a top view of a portion of the upper lid cover 12 is shown with the upper lid drink opening 30 rotated to the right in a closed position. The upper lid drink opening 30 is disposed over a portion of the rim 42 of the lower lid cover 14. Note arrow 62 indicates the rotation left and right of the upper lid cover 12 on top of the lower lid cover 14. By rotating the upper lid cover 12 to the left and indexing the upper lid drink opening 30 with the lower lid drink opening 44, the beverage 22 is ready for drinking from the drink container 18 as shown in FIG. 2.

It should be mentioned that it is anticipated that the upper lid cover could also be in the form of a simple ring with the ring having a drink opening. The ring received in a snap/ press fit on a lower lid cover with a drink opening. The upper ring and lower lid cover having the open/close drink opening feature as mentioned above. The lower lid cover may or may not include aroma vent holes.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A container lid designed for allowing an aroma from a beverage to escape from a drink container, the drink container holding the beverage therein, the drink container having an open top and an annular lip therearound, the container lid comprising:

an upper lid cover having a plurality of aroma vent holes in a center portion of said upper lid cover, said upper lid cover having an upper lid drink opening in an outer periphery thereof; and a lower lid cover having a plurality of aroma vent holes in a center portion of said lower lid cover, said lower lid cover having a lower lid drink opening in an outer periphery thereof, said upper lid cover disposed on top of said lower lid cover;

whereby said lower lid cover is adapted for receipt on the annular lip of the drink container, said lower lid cover adapted for receipt above a liquid level of the beverage to prevent the beverage from leaking through said aroma vent holes and allowing sufficient space for steam rising from the beverage to penetrate said aroma vent holes.

2. The container lid as described in claim 1 wherein said upper lid cover is rotatably mounted on said lower lid cover for indexing said upper lid drink opening with said lower lid drink opening.

3. The container lid as described in claim 1 wherein said upper lid cover includes an annular upper lid top portion with a downwardly extending exterior upper lid skirt, said upper lid skirt disposed around an outer circumference of said upper lid top portion, said lower lid cover having an annular lower lid top portion with a raised rim therearound and a downwardly extending exterior flange disposed around an outer circumference of said rim, a portion of said upper lid skirt received around a portion of said exterior flange in a press fit.

4. The container lid as described in claim 3 wherein said exterior flange includes a first annular lip groove and a second annular groove therein, said first and second annular lip grooves adapted for receiving lips of different diameter drink containers.

5. The container lid as described in claim 3 wherein said upper lid cover includes an upper recess area formed in part of said upper lid top portion, said upper recess area includes said aroma vent holes therein, said lower lid cover includes a lower recess area formed in said lower lid top portion, said lower recess area includes said aroma vent holes therein, a lower portion of said upper recess area received in said lower recess area with a space therebetween.

6. The container lid as described in claim 3 wherein said lower recess area includes a lower recess wall therearound, said wall having a pair of stops therein, said stops engaging an upper recess wall, said upper recess wall disposed around said upper recess area.

7. The container lid as described in claim 5 wherein said upper recess area includes a beverage drain hole therein, said upper recess area angled downwardly toward said drain hole for draining any spilled beverage received in said upper recess area out said drain hole.

8. The container lid as described in claim 3 wherein said upper lid skirt includes two sets of vertical ribs diagonally opposed on said skirt and formed therein for gripping said upper lid cover and rotating said upper lid cover on said lower lid cover.

9. A container lid designed for allowing an aroma from a beverage to escape from a drink container, the drink container holding the beverage therein, the drink container having an open top and an annular lip therearound, the container lid comprising:

an upper lid cover having an annular upper lid top portion and a downwardly extending exterior upper lid skirt, said upper lid skirt disposed around an outer circumference of said upper lid top portion, said upper lid top portion having an upper recess area therein, said upper recess area having a plurality of aroma vent holes therein, said upper lid cover having an upper lid drink opening in an outer periphery thereof and disposed next to said upper recess area; and a lower lid cover having an annular lower lid top portion with a rim therearound and a downwardly extending exterior flange disposed around an outer circumference of said rim, a portion of said upper lid skirt received around a portion of said exterior flange in a press fit, said lower lid top portion having a lower recess area therein, said lower recess area having a plurality of aroma vent holes therein, said rim having a lower lid drink opening in an outer periphery thereof;

said upper lid cover disposed on top of said lower lid cover and rotatably mounted thereon for indexing said upper lid drink opening with said lower lid drink opening, said lower lid cover adapted for receipt on the annular lip of the drink container, said lower lid cover adapted for receipt above a liquid level of the beverage to prevent the beverage from leaking through said aroma vent holes and allowing sufficient space for steam rising from the beverage to penetrate said aroma vent holes.

10. The container lid as described in claim 9 wherein a lower portion of said upper recess area is received inside an upper portion of said lower recess area with a space formed therebetween.

11. The container lid as described in claim 9 wherein said lower recess area includes a lower recess wall formed therearound, said lower recess wall having a pair of spaced apart stops therein, said stops engaging an upper recess wall, said upper recess wall disposed around said upper recess area.

12. The container lid as described in claim 9 wherein the aroma vent holes in said upper and lower recess areas are cone shaped.

13. The container lid as described in claim 9 wherein said upper recess area includes a beverage drain hole disposed next to said upper lid drink opening, said upper recess area angled downwardly toward said drain hole for draining any spilled beverage received in said upper recess area out said drain hole.

14. The container lid as described in claim 9 wherein said exterior flange includes a first annular lip groove and a second annular lip groove therein, said first and second annular lip grooves adapted for receiving lips of different diameter drink containers in a press fit.

* * * * *